US008276395B2

(12) United States Patent
Lifson et al.

(10) Patent No.: US 8,276,395 B2
(45) Date of Patent: Oct. 2, 2012

(54) PULSE WIDTH MODULATION WITH REDUCED SUCTION PRESSURE TO IMPROVE EFFICIENCY

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 689 days.

(21) Appl. No.: 12/526,065

(22) PCT Filed: Feb. 15, 2007

(86) PCT No.: PCT/US2007/004206

§ 371 (c)(1),
(2), (4) Date: Aug. 6, 2009

(87) PCT Pub. No.: WO2008/100261

PCT Pub. Date: Aug. 21, 2008

(65) Prior Publication Data

US 2010/0319372 A1 Dec. 23, 2010

(51) Int. Cl.
*F25B 49/00* (2006.01)
*F01C 1/02* (2006.01)

(52) U.S. Cl. ..... 62/196.1; 62/196.3; 418/55.5

(58) Field of Classification Search ..... 62/196.1, 62/196.2, 196.3, 196.4, 197, 228.1; 418/55.1, 418/55.5

See application file for complete search history.

(56) References Cited

U.S. PATENT DOCUMENTS

| | | | | |
|---|---|---|---|---|
| 4,180,986 | A | 1/1980 | Shaw | |
| 4,335,582 | A | 6/1982 | Shaw et al. | |
| 5,167,491 | A | 12/1992 | Keller, Jr. et al. | |
| 6,047,556 | A | 4/2000 | Lifson | |
| 6,449,972 | B2 | 9/2002 | Pham et al. | |
| 6,931,867 | B2 | 8/2005 | Healy | |
| 7,325,411 | B2 * | 2/2008 | Bush | 62/197 |
| RE40,400 | E * | 6/2008 | Bass et al. | 417/44.2 |
| 2010/0043468 | A1 * | 2/2010 | Lifson et al. | 62/196.3 |

OTHER PUBLICATIONS

International Preliminary Report mailed Aug. 27, 2009.
Search Report and Written Opinion mailed on Jul. 24, 2008 for PCT/US2007/04206.

* cited by examiner

*Primary Examiner* — Marc Norman
(74) *Attorney, Agent, or Firm* — Carlson, Gaskey & Olds, PC

(57) ABSTRACT

The present invention relates to a way of reducing the amount of energy required to partially compress a refrigerant in a compressor operating in a rapidly cycled unloaded mode. A valve on a suction line is closed when the compressor moves to the unloaded condition. In this manner, the amount of energy required to partially compress the refrigerant in the compressor, at the unloaded condition, is dramatically reduced.

14 Claims, 1 Drawing Sheet

PULSE WIDTH MODULATION WITH REDUCED SUCTION PRESSURE TO IMPROVE EFFICIENCY

BACKGROUND OF THE INVENTION

The present invention relates to a method of increasing efficiency of heating ventilation, air conditioning and refrigeration (HVAC&R) systems, wherein the compressor operates in a rapidly cycled unloaded mode when reduced system capacity is required. The present invention is directed to noticeably reducing the amount of compression work that is performed at these unloaded conditions when no or little amount of refrigerant is pumped through the compressor.

Refrigerant systems are utilized in many applications, such as air conditioners, heat pumps, refrigeration units, etc. As is known, a refrigerant is compressed in a compressor and then is circulated throughout the refrigerant system to condition a secondary fluid such as air supplied to a climate controlled indoor environment. Most of the time, the refrigerant systems operate unloaded, since full-load capacity is not demanded to compensate for various components of thermal load in the conditioned environment. Therefore, it is desirable to operate the refrigerant system as efficiently as is possible, and especially at part-load conditions.

Improving compressor efficiency is a goal of a design engineer as a compressor typically represents the highest source of power consumption in the refrigerant system. The compressors consume power by compressing the refrigerant from a suction pressure to a discharge pressure. The refrigerant system controls known in the art monitor and maintain temperature and humidity in the conditioned environment within specified tolerance bands, and adjust the capacity provided by the refrigerant system via compressor unloading when the thermal load in the conditioned space and demand for the refrigerant system capacity are reduced.

Various ways of reducing refrigerant system capacity by compressor unloading are known. In one known method, compression elements of a so-called scroll compressor are allowed to move in and out of engagement with each other at a fast periodic rate, typically being in the range of 5 to 30 seconds. When the two compression elements are engaged, the compressor provides a full-load capacity. When the two compression elements are out of engagement, they will no longer compress and circulate the refrigerant throughout the system.

Another way of unloading the compressor is to allow at least a portion of compressed refrigerant return to a suction line.

In either case, a noticeable amount of power is consumed to compress the residual refrigerant inside the compressor. As an example, in the system mentioned above, wherein the scroll compression elements are allowed to move away from each other, there is still some compression taking place on residual refrigerant, resulting into lost compression work and reduced refrigerant system efficiency.

The present invention is directed to reducing the amount of such wasted compression work and improving refrigerant system efficiency at part-load operation.

SUMMARY OF THE INVENTION

In the disclosed embodiment of this invention, a suction valve controlling the flow of suction refrigerant into the compressor is closed when the compressor is being operated in an unloaded mode. The valve is then opened (partially or fully) when the compressor is returned to the normal loaded mode.

The valve moves from an open position to a closed position in a rapid fashion. The valve cycling rate is normally in the range of 5 to 30 seconds. The cycling rate is selected to optimize the valve reliability and allow the conditioned environment to maintain the desirable temperature level. If the valve is cycled to a often, the reliability of the valve can be compromised and if the valve is cycled infrequently the temperature within the conditioned environment may not be precisely controlled. Motor overheating can also occur, if the valve stays in the closed position for a substantial period of time, as the amount of refrigerant available to cool the motor is reduced. In this manner, the suction pressure reaching the compressor pump elements, when the compressor is in the unloaded mode, is reduced. Therefore, the amount of work required to operate the compressor in this unloaded condition is dramatically reduced. Thus, the present invention improves compressor and overall refrigerant system efficiency at part-load conditions, in comparison to the prior art.

In one embodiment, the compressor is a scroll compressor having two scroll compression elements. As is known, a refrigerant system may utilize a pulse width modulation control to periodically open and close a flow of a pressurized refrigerant to a chamber utilized to hold the two scroll compression members in contact with each other. When the two compression members are held in contact with each other, they can compress a refrigerant and deliver it downstream to other components within the refrigerant system. However, the pulse width modulation control periodically blocks flow of the pressurized refrigerant to this chamber. At that time, the scroll members can move out of contact with each other. When the scroll members are out of contact with each other, refrigerant is still compressed within the compression chambers, due to a finite gap between the unloaded scroll elements; however, the refrigerant will not be fully compressed. Further, in such a system, a flow control device positioned on the discharge line typically blocks flow of the refrigerant to a downstream condenser. Instead, a bleed line is opened to allow this partially compressed refrigerant to return to the suction line. By blocking off the suction flow to the compressor under these conditions, the present invention reduces the amount of work performed by the compressor, and thus increases the efficiency of the refrigerant system.

In another embodiment, the unloaded condition is simply allowing the discharge line to communicate back to the suction line. Again, by utilizing a control of a suction valve to block suction flow, the present invention reduces the power consumption required to partially compress the refrigerant.

These and other features of the present invention can be best understood from the following specification and drawings, the following of which is a brief description.

DETAILED DESCRIPTION OF THE PREFERRED EMBODIMENTS

Figure 1A:
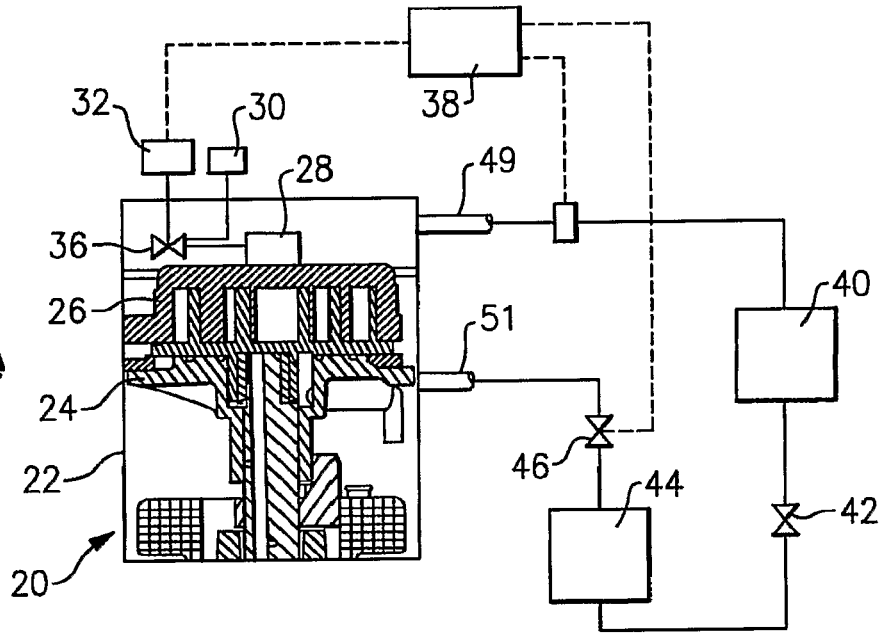
FIG. 1A is a schematic of a first embodiment of this invention.

A refrigerant system 20 is illustrated in FIG. 1A having a compressor 24. The compressor 24 is a scroll compressor having a non-orbiting scroll 26 inter-fitting with an orbiting scroll 24. As known, the non-orbiting scroll 26 can move axially relative to the orbiting scroll 24. A chamber 28 receives a flow of pressurized refrigerant from a source 30. As known in the art, the pressurized source is normally at a higher pressure when the scrolls need to be engaged and at a lower pressure when the scroll elements need to be disengaged from each other. Often, the source of a higher pressure would be a discharge pressure and the source of a lower pressure would be a suction pressure. Also, as known in the art, the switch between a higher and lower pressure is accomplished by some type of a valving mechanism. The control 32 controls the flow of the pressurized refrigerant from the source 30 to a valve 36. By controlling the flow of the pressurized refrigerant to the chamber 28, the non-orbiting scroll 26 can come in contact with the orbiting scroll 24, or allow it to move away from the orbiting scroll 24. In one known embodiment, the control 32 communicates with an electronic control 38, which causes the valve 36 to be repeatedly opened and closed utilizing pulse width modulation technique. When the valve 36 is closed, refrigerant flow to the chamber 28 is blocked. Under these conditions, the compressor 22 is effectively unloaded as the non-orbiting scroll 26 is allowed to move away from the orbiting scroll 24.

Under normal operating conditions, refrigerant is compressed in the compressor 22, passes through a condenser 40, and an expansion device 42, and is delivered to an evaporator 44. Refrigerant passes back into the compressor 22 through a suction line 51. However, when a reduction in capacity is desired, the control 38 operates the valve 36 along with the pulse width modulation control 32 to repeatedly and rapidly open and close the valve 36 utilizing a pulse width modulation technique. As this occurs, the non-orbiting scroll member 26 is allowed to repeatedly move away from and toward the orbiting scroll member 24. The operation and control of this system is as known in the art. It is the control of the suction valve 46 that is inventive here.

Figure 1B:
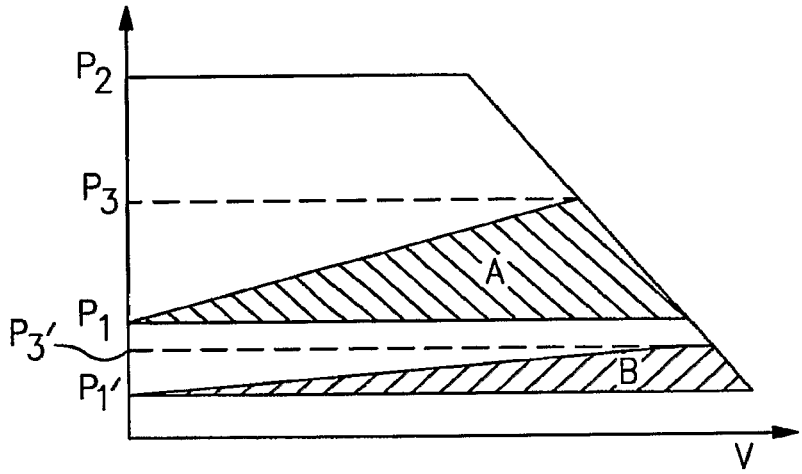
FIG. 1B graphically shows the reduced power consumption of the present invention.

In the present invention, operation under normal conditions is shown in FIG. 1B, where the compressor compresses the refrigerant between suction pressure $P_1$ and discharge pressure $P_2$. Also, the operation under the prior art unloaded condition is between a suction pressure $P_1$ and a discharge $P_3$.

The work shown in the area A is all lost work with this prior art system. All this work is lost as essentially no refrigerant is pumped through the compressor. The refrigerant is compressed from a relatively high suction pressure $P_1$ to a relatively high discharge pressure $P_3$. This is all work lost.

With the present invention, by blocking the flow of suction refrigerant to the compressor through the line 51 by the valve 46, the suction pressure $P_1'$ and discharge pressure $P_3'$ are both reduced. Blocking of the refrigerant flow in the line 51 by the valve 46 preferably occurs shortly before the scroll compressor elements are disengaged. In this case, the suction pressure downstream of the valve 46 is reduced, as the refrigerant will be pumped out from the compressor lower shell, dropping to a low pressure value $P_1'$. When the suction pressure $P_1'$ downstream of the valve 46 is reduced to the acceptable level, the scroll elements are disengaged. Under such circumstances, the lost compression work is equivalent to a much smaller area shown at B in FIG. 1B. Thus, by selectively blocking the flow of refrigerant through the suction valve 46 to the suction line 51, when the compressor is operated in an unloaded condition, the amount of work required to be performed by the compressor 22 in the unloaded mode is dramatically reduced. When the compressor returns into the normal compression mode, the valve 46 is opened to permit the normal flow of refrigerant into the compressor 22. Notably, the areas shown in FIG. 1B are an illustration and indicative of the compressor power consumption reduction, and not an exact empirical laboratory result. Even so, substantial energy savings are expected with the present invention.

Figure 2:
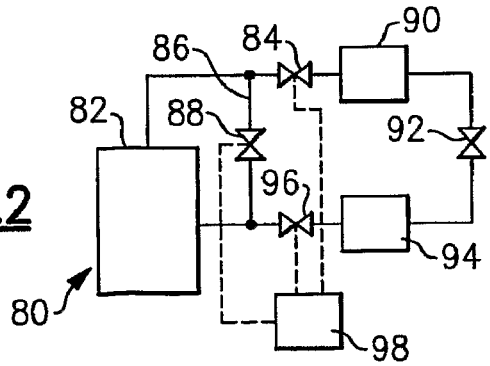
FIG. 2 shows another embodiment.

FIG. 2 shows a refrigerant system 80 incorporating a compressor 82, downstream shutoff valve 84, an unloader line 86 and a shutoff valve 88 on the unloader line 86. While the unloader line 86 may be a standard discharge line delivering compressed refrigerant downstream to a condenser as shown in FIG. 2, the unloader line may also be connected to an intermediate compression point in the compression process. For purposes of the claims in this application, either location will be termed a "discharge line." A condenser 90, an expansion valve 92 and an evaporator 94 are positioned downstream of the compressor 80. A suction shutoff valve 96 and an unloader shutoff valve 88 are both controlled by a control 98. When reduced capacity is desired, the valve 84 is closed, the unloader valve 88 is opened, and the suction valve 96 is closed. Benefits, such as mentioned above with regard to the first embodiment, will then be achieved compared to normal unloaded operation. To prevent the refrigerant overpressurization in the discharge line, due to the closing of the valve 84, the valve 88 is open at roughly the same time as the valve 84 is closed. The valve 84 allows the refrigerant to be by-passed upstream of valve 96 into the suction line. Again, the valve 96 is closed shortly before the valve 84 is closed and shortly before valve 88 is opened. As explained above, this is done to reduce the suction pressure downstream of the valve 96 prior to initiation of the unloaded operation. The compression work diagram for the unloaded operation would be similar to the one represented by the cross-hatched area "B" in FIG. 1B.

While two distinct ways of unloading a compressor are shown, it should be understood that any manner of unloading a compressor will benefit from the teachings of this invention. By closing off the inlet flow, the suction pressure experienced by the compressor will be reduced. In this manner, the amount of wasted compression work will be reduced as well.

It should be pointed out that many different compressor types could be used in this invention. For example, scroll, screw, rotary, or reciprocating compressors can be employed.

The refrigerant systems that utilize this invention can be used in many different applications, including, but not limited to, air conditioning systems, heat pump systems, marine container units, refrigeration truck-trailer units, and supermarket refrigeration systems.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor for compressing a refrigerant and delivering said refrigerant to a downstream condenser, an expansion device positioned downstream of said condenser, an evaporator positioned downstream of said expansion device, and a suction valve positioned on a suction line leading from said evaporator back to said compressor;

said compressor being provided with a rapidly cycled unloaded mode where a discharge valve intermediate said compressor and said condenser blocks flow of refrigerant from said compressor to said condenser when the compressor is in said unloaded mode, a bypass line communicating a discharge line from said compressor back to said suction line, said bypass line communicating with said suction line at a position downstream of said suction valve; and a control for closing said suction valve and said discharge valve when said compressor is moved into said unloaded mode, said unloaded mode occurs by opening a third valve, said third valve being on said bypass line, and said third valve allowing refrigerant from said discharge line to flow back to said suction line downstream of said suction valve.

2. The refrigerant system as set forth in claim 1, wherein said control closes said discharge valve and opens said third valve at approximately the same time.

3. The refrigerant system as set forth in claim 1, wherein said suction valve is closed shortly before said discharge valve is closed.

4. The refrigerant system as set forth in claim 3, wherein said suction valve is closed shortly before said third valve is opened.

5. The refrigerant system as set forth in claim 1, wherein said suction valve is closed shortly before said orbiting scroll and said non-orbiting scroll are allowed to move out of contact with each other.

6. A refrigerant system comprising:

a compressor for compressing a refrigerant and delivering said refrigerant to a downstream condenser, an expansion device positioned downstream of said condenser, an evaporator positioned downstream of said expansion device, and a suction valve positioned on a suction line leading from said evaporator back to said compressor;

said compressor being provided with a rapidly cycled unloaded mode;

a control for closing said suction valve when said compressor is moved into said unloaded mode; and said compressor is a scroll compressor with an orbiting scroll and a non-orbiting scroll, and a biasing chamber for holding said orbiting scroll and said non-orbiting scroll in contact with each other, and in said unloaded mode said biasing chamber being periodically provided with a compressed fluid, and periodically relieved of the compressed fluid such that said orbiting scroll and said non-orbiting scroll are allowed to repeatedly move into and out of contact with each other, said unloaded mode occurring when said orbiting scroll and said non-orbiting scroll are allowed to move out of contact with each other.

7. The refrigerant system as set forth in claim 6, wherein said non-orbiting scroll receives a biasing force from said compressed fluid behind a base of said non-orbiting scroll, said biasing force moving said non-orbiting scroll into contact with said orbiting scroll.

8. A method of operating a refrigerant system comprising the steps of:

(a) providing a compressor for compressing a refrigerant and delivering said refrigerant to a downstream condenser, an expansion device positioned downstream of said condenser, an evaporator positioned downstream of said expansion device, and a suction valve positioned on a suction line leading from said evaporator back to said compressor;

(b) providing said compressor with a rapidly cycled unloaded mode where a discharge valve intermediate said compressor and said condenser blocks flow of refrigerant from said compressor to said condenser when the compressor is in said unloaded mode, a bypass line communicating a discharge line from said compressor back to said suction line, said bypass line communicating with said suction line at a position downstream of said suction valve; and (c) closing said suction valve and said discharge valve when said compressor is moved into said unloaded mode, said unloaded mode occurs by opening a third valve, said third valve being on said bypass line, and said third valve allowing refrigerant from said discharge line to flow back to said suction line downstream of said suction valve.

9. The method as set forth in claim 8, including the steps of closing said discharge valve and opening said third valve at approximately the same time.

10. The method as set forth in claim 8, wherein said suction valve is closed shortly before said discharge valve is closed.

11. The method as set forth in claim 8, wherein said suction valve is closed shortly before said third valve is opened.

12. A method of operating a refrigerant system comprising the steps of:

(a) providing a compressor for compressing a refrigerant and delivering said refrigerant to a downstream condenser, an expansion device positioned downstream of said condenser, an evaporator positioned downstream of said expansion device, and a suction valve positioned on a suction line leading from said evaporator back to said compressor;

(b) providing said compressor with a rapidly cycled unloaded mode;

(c) providing a control for closing said suction valve when said compressor is moved into said unloaded mode; and (d) said compressor being a scroll compressor with an orbiting scroll and a non-orbiting scroll, and providing a biasing chamber for holding said orbiting scroll and said non-orbiting scroll in contact with each other, and in said unloaded mode said biasing chamber being periodically provided with a compressed fluid, and periodically relieved of the compressed fluid such that said orbiting scroll and said non-orbiting scroll are allowed to repeatedly move into and out of contact with each other, said unloaded mode occurring when said orbiting scroll and said non-orbiting scroll are allowed to move out of contact with each other.

13. The method as set forth in claim 12, wherein said non-orbiting scroll receives a biasing force from said compressed fluid behind a base of said non-orbiting scroll, said biasing force moving said non-orbiting scroll into contact with said orbiting scroll.

14. The method as set forth in claim 12, wherein said suction valve is closed shortly before said orbiting scroll and said non-orbiting scroll are allowed to move out of contact with each other.

* * * * *